US006481827B2

(12) United States Patent
Yearout

(10) Patent No.: US 6,481,827 B2
(45) Date of Patent: Nov. 19, 2002

(54) MODULAR INK ABSORBENT SYSTEM FOR INKJET SPITTOONS

(75) Inventor: Russell P. Yearout, Brush Prairie, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 19 days.

(21) Appl. No.: 09/773,425

(22) Filed: Jan. 31, 2001

(65) Prior Publication Data

US 2002/0101473 A1 Aug. 1, 2002

(51) Int. Cl.[7] ..... B41J 2/165
(52) U.S. Cl. ..... 347/36
(58) Field of Search ..... 347/36, 29, 33, 347/31, 35, 86; 141/351

(56) References Cited

U.S. PATENT DOCUMENTS

| | | | | |
|---|---|---|---|---|
| 5,617,124 A | | 4/1997 | Taylor et al. | 347/35 |
| 5,617,125 A | | 4/1997 | Chew | 347/36 |
| 5,742,303 A | | 4/1998 | Taylor et al. | 347/36 |
| 5,997,128 A | | 12/1999 | Lou et al. | 347/33 |
| 6,050,671 A | | 4/2000 | Rotering | 347/35 |
| 6,062,672 A | * | 5/2000 | Ishize et al. | 347/30 |
| 6,082,848 A | | 7/2000 | Taylor | 347/35 |
| 6,132,026 A | | 10/2000 | Taylor et al. | 347/29 |
| 6,168,258 B1 | | 1/2001 | Lou et al. | 347/33 |
| 6,213,583 B1 | | 4/2001 | Therlen | 347/36 |
| 6,247,783 B1 | | 6/2001 | Shibata et al. | 347/35 |
| 6,318,838 B1 | | 11/2001 | Anderson et al. | 347/36 |
| 6,340,220 B1 | | 1/2002 | Gaylor et al. | 347/35 |

* cited by examiner

*Primary Examiner*—John S. Hilten
*Assistant Examiner*—Shih-Wen Hsieh

(57) ABSTRACT

A modular ink absorbent system for channeling waste ink spit from a printhead in an inkjet printing mechanism to a permanent storage location while isolating the ink from contaminating other components in the mechanism. An absorbent core has a spit target that receives the waste ink and an exit surface. A pair of support walls of a flexible or rigid, fluid impervious material sandwich the core between them. The exit surface is in fluid communication with the storage location and the support walls channel the ink from the target surface to the permanent storage location. The support walls have mounting structures which mate easily with mounting structures on the printer service station frame to accurately locate the target from the printhead. A method of conducting ink spit through a printing mechanism, along with an inkjet printing mechanism having such a modular ink absorbent system, are also provided.

15 Claims, 3 Drawing Sheets

MODULAR INK ABSORBENT SYSTEM FOR INKJET SPITTOONS

INTRODUCTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

Due to the different natures of their compounds, pigment based inks and dye based inks have different servicing requirements, particularly when purging or "spitting" the printheads in a service station spittoon. Much research has been conducted over the past few years concerning the servicing of pigment based inks, for instance as described in U.S. Pat. Nos. 5,617,124; 6,082,848; 5,742,303; 5,980,018; 6,132,026; and 6,050,671, all currently assigned to the Hewlett-Packard Company, the present assignee of the technology disclosed herein; however, relatively few advances have been made in spittoons for dye based inks. One recent dye based ink spittoon having a fibrous liner of a polyester material was first commercially available in the Hewlett-Packard Company's Professional Series 2000C color inkjet printer. This earlier fibrous ink absorber was very flexible and dimensionally imprecise, leading to difficulties in assembly and quality control. One solution to this fibrous absorber was a porous plastic ink absorber, made of a sintered polyethylene foam which could be molded into a rigid part. Unfortunately, this porous plastic absorber had a limited thickness and void volume, so less ink could be absorbed by the finished product. Moreover, the porous plastic absorber was very stiff and brittle, requiring tighter tolerances for mating parts, and was typically more expensive to manufacture than a fibrous absorber. Thus, a need existed for a dye based ink absorber, which could be easily assembled into a spittoon, and which maintained tight dimensional tolerances without adversely impacting other components in the system.

DETAILED DESCRIPTION OF A PREFERRED EMBODIMENT

Figure 1:
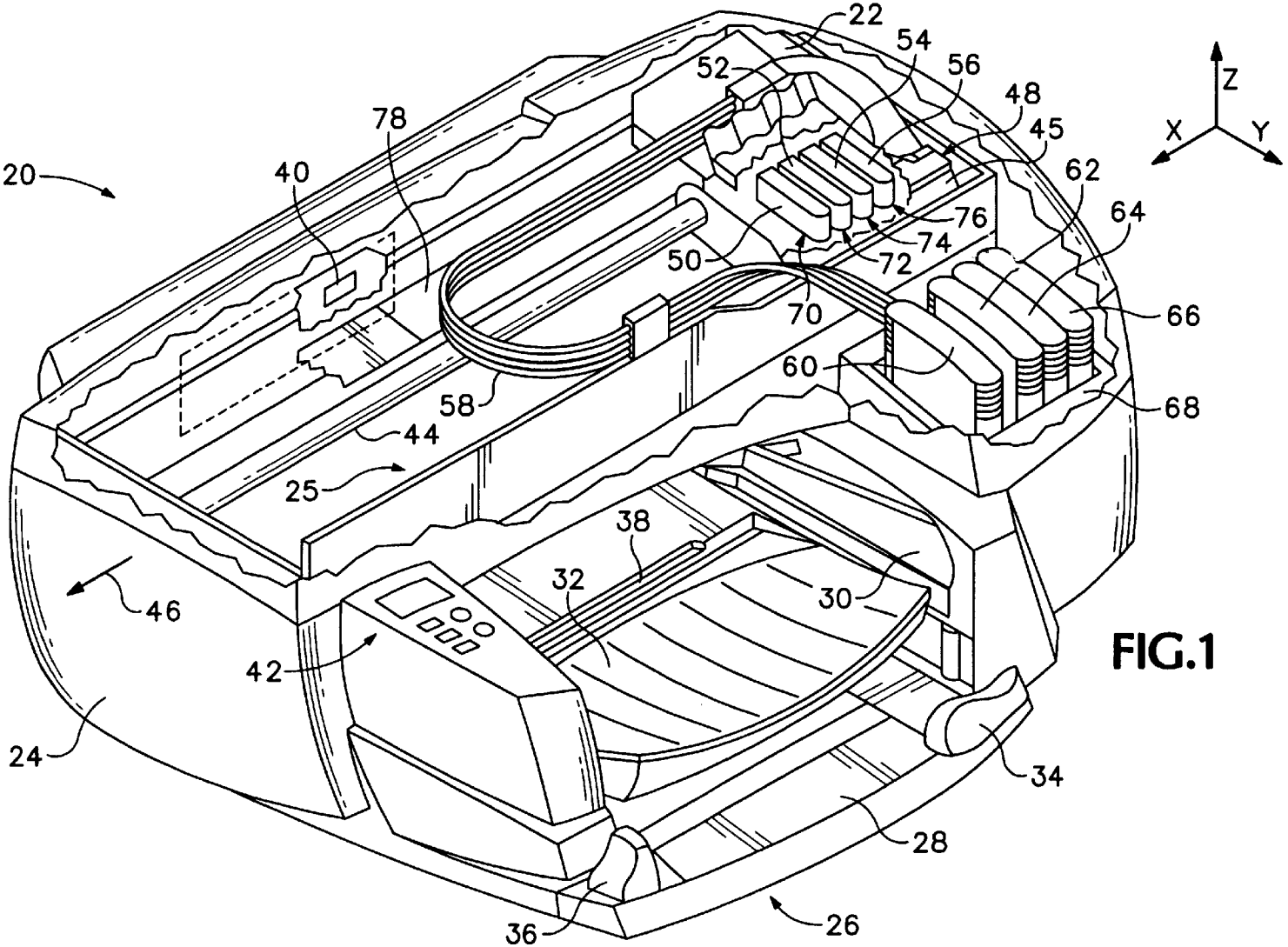
FIG. 1 is a perspective view of one form of an inkjet printing mechanism, here, an inkjet printer, including a printhead service station having a spittoon using one form of a modular ink absorbent system for absorbing ink residue purged or "spit" from an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a DC (direct current) motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

In the printzone 25, a media sheet receives ink from an inkjet cartridge, such as a black ink cartridge 50 and three monochrome color ink cartridges 52, 54 and 56, shown in FIG. 1. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Other more traditional ink delivery systems have semi-permanent printheads with replaceable ink supplies which are typically snapped onto the printheads, and thus, these systems are known in the art as "snapper" systems. Another traditional ink delivery system uses replaceable inkjet cartridges with the printheads being permanently attached to the ink reservoir, so when an empty cartridge is replaced, a brand new printhead accompanies the new cartridge. The concepts illustrated herein may be used with any of these different types of systems, as well as hybrid inkjet dispensing systems and their equivalents.

The illustrated pens 50–56 each include small reservoirs for storing a supply of ink in an "off-axis" ink delivery system, which is in contrast to a snapper system or a replaceable cartridge system. Hence, a snapper or replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to form an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Figure 2:
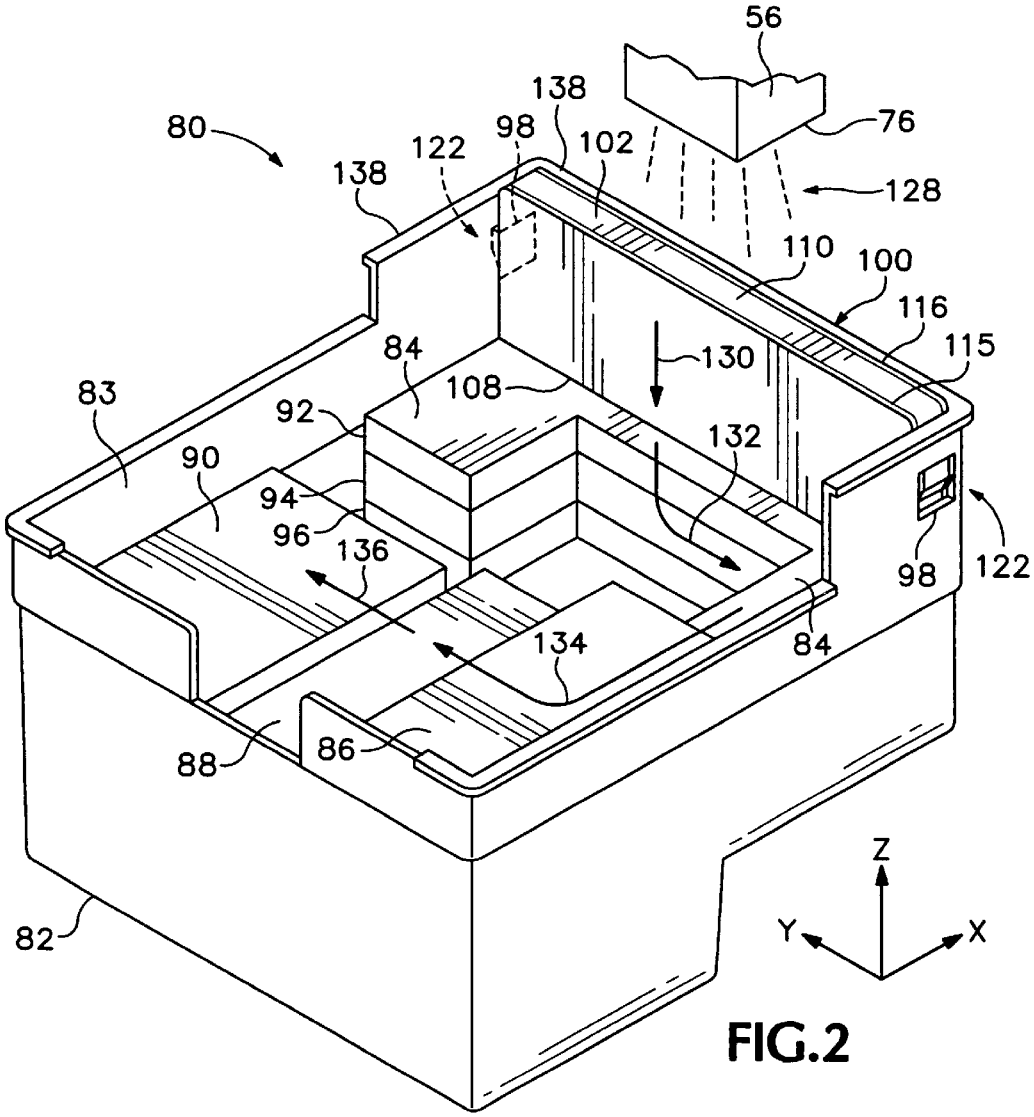
FIG. 2 is an enlarged, perspective view of the service station of FIG. 1, showing a waste ink spittoon or "bucket."

FIG. 2 shows one form of a modular, laminated ink absorber spittoon 80, constructed in accordance with the present invention. Here we see the spittoon 80 having a solid frame 82, also known in the art as a "bucket," which defines a waste ink storage reservoir or spittoon 83 therein. Indeed, a similarly sized porous plastic absorber has typically less than 40% of its volume available as voids for waste ink containment, whereas the illustrated laminated ink absorber 100 has up to a 90% void volume available to contain ink. Thus, the laminated absorber 100 has over twice the ink volume capacity that was available using the earlier porous plastic absorber.

The spittoon reservoir 83 may be lined with one or more ink absorbent pads, which may be constructed of any type of liquid absorbent material, such as of a felt, pressboard, sponge or other material. In the illustrated embodiment, a series of different absorbers are used, including a first absorber 84, a second absorber 86, a third absorber 88 and a fourth absorber 90. While these absorbers 84–90 may be each constructed of a single block of material, cut to a desired shape to conform with other service station components, it may be preferable in some implementations, as shown in the illustrated embodiment, to make each of these pads from a series of subpads, such as subpads 92, 94 and 96 which are stacked together to create the fibrous absorber 84.

Besides housing other service station components, such as printhead caps and wipers (omitted for clarity), the service station bucket 82 may also serve as a mounting support, such as by defining a pair of mounting slots 98 which extend through the opposing front and rear walls of the bucket 82. A modular, laminated ink absorber system 100 is installed in the bucket 82 using slots 98. The modular ink absorber system 100 soaks up dye based ink spit from the color printheads 72–76, with another spittoon system (not shown) being used to handle the pigment based ink spit from the black printhead 70.

Figure 3:
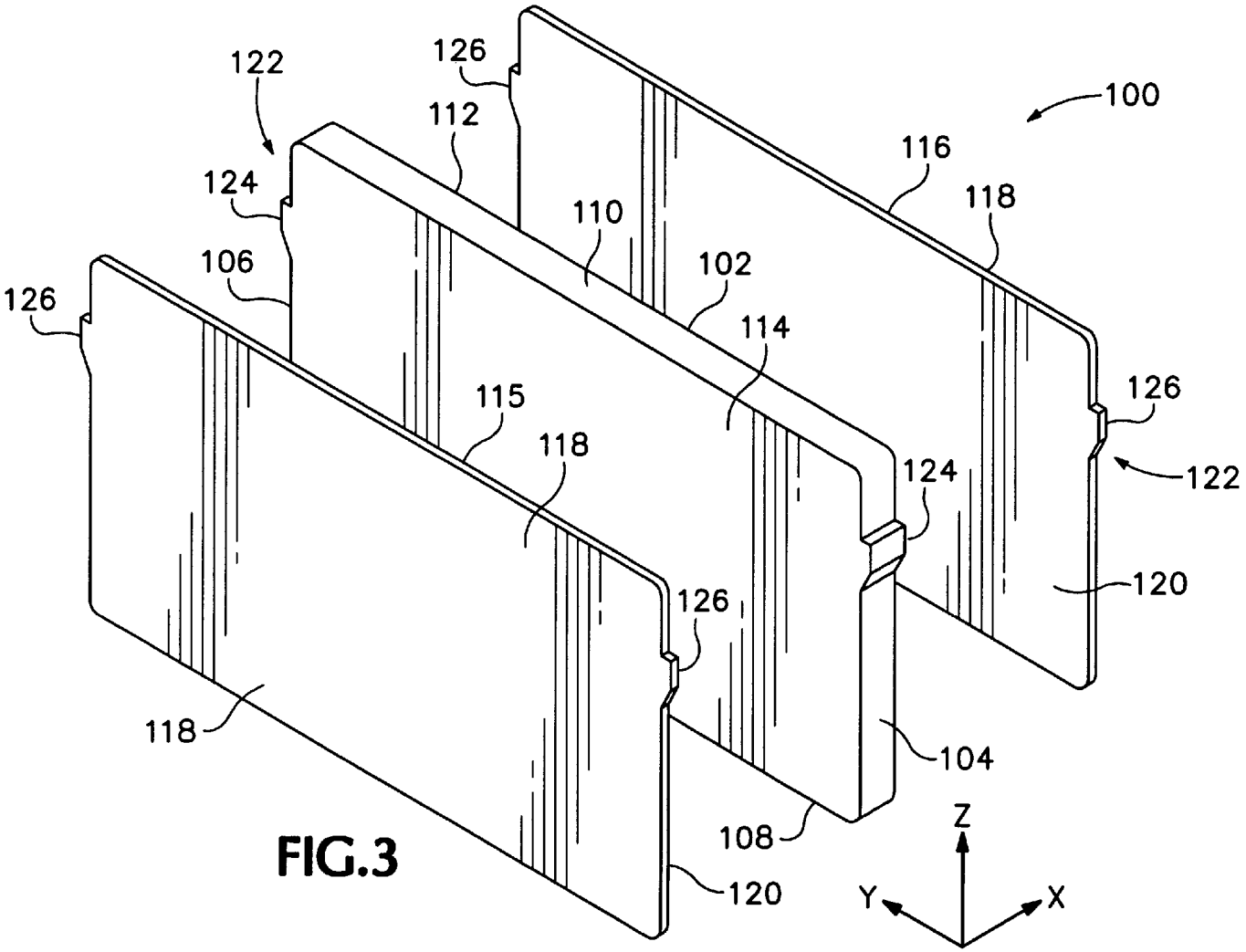
FIG. 3 is an enlarged, perspective, exploded view of the modular ink absorbent system of FIG. 1.

FIG. 3 illustrates in greater detail the modular, laminated ink absorber system 100. A central core or body 102 of a fibrous material is formed in the illustrated embodiment with a roughly rectangular shape, having a front surface 104, a rear surface 106, a bottom surface 108, an upper spit target surface 110, an inboard surface 112, and an outboard surface 114. As used herein, the term "inboard" refers to components orientated toward the printzone 25 (positive X-axis direction), and "outboard" refers to components orientated away from the printzone 25 (negative X-axis direction). To assist in service station assembly, and maintaining dimensional stability of the absorber system 100, at least one of the core surfaces, other than the spit target surface 110, is preferably bonded to a rigid or semi-flexible support wall, which has a rigidity and stiffness greater than that of the core material. In the illustrated embodiment, the core 102 being sandwiched between two support walls 115 and 116. The illustrated support walls 115 and 116 each have an exterior surface 118 and an interior surface 120. The interior surfaces 120 of walls 115 and 116 are each bonded to the outboard and inboard surfaces 114 and 112, respectively, of the core 102. It is apparent that in other implementations it may be more helpful to have only a single wall, or more than two walls, of the central core 102 bonded to support walls, such as walls 115, 116.

In the illustrated embodiment, the front and rear surfaces of both the core 102 and the support walls 115, 116 are each formed to have mounting projections or tabs 122 projecting therefrom, with the core 102 having projecting portions 124 extending therefrom, and walls 115, 116 each having projections 126 extending therefrom, with projections 124 and 126 together forming the mounting tabs 122. The front and rear mounting tabs 122 extend through slots 98 within the bucket 82 to secure the laminated absorber system 100 within the service station reservoir 83. As shown in FIG. 2, the laminated absorber system 100 becomes the initial input ink receiver for the color ink spittoon system, as shown by example with pen 56 shooting droplets of purged ink spit 128 onto the spit target surface 110.

In operation, the dye-based ink of the color pens 52–56 is spit by their respective printheads 72–76 sequentially (one at a time) onto the spit target 110 of the laminated absorber 100. Of course, if a wider absorber 100 were used, all three pens 52–56 may be purged simultaneously, but at the expense of increasing the overall width of the printer 20, increasing the footprint of the printer (amount of desk space or work space consumed by the printer). From the spit target surface 110, the ink is drawn under capillary pressure, also known as a "wicking" action, in the direction of arrow 130 through the absorbent core 102, out through the bottom surface 108 and into the first liner pad 84. The liquid volatiles in the ink may then travel through capillary action from pad 84, to pad 86, then to pad 88, and finally into pad 90, as illustrated by arrows 132, 134 and 136 in FIG. 2. During this capillary travel, many liquid components of the ink composition are volatile in nature, and evaporate during this transportation process, leaving the absorbers 102, and 84–90 to trap and store the ink solids, including dye particles or colorants, left behind as the volatiles evaporate.

Some examples of typical materials which may be used to construct the laminated ink absorber 100 will now be discussed. First, the core 102 may be constructed from a fibrous material, preferably of polyester fibers, polypropylene fibers, rayon fibers, polyethylene fibers, nylon fibers, polyurethane fibers, etc. The supports walls 115, 116 may be constructed from of a fluid impervious, rigid, semi-rigid, or flexible sheet of material, preferably from a plastic sheet of polyester, polypropylene, nylon, polyurethane or mylar. A variety of different means may be used to bond the exterior support walls 115, 116 to the fibrous core 102, for instance using a pressure sensitive adhesive, although in some instances heat bonding or other bonding means may be preferred. Indeed, clips or fasteners may also be used to attach the support walls 115, 116 to the fibrous core 102, although adhesive bonding is preferred for simplicity and economics.

In the illustrated embodiment, the laminated absorber 100 was formed by first sandwiching and bonding a large sheet of the core material between large sheets of the inboard and outboard wall material, after which a dye is used to punch out the illustrated geometry shown in FIG. 3. Use of a dye punch procedure to form the laminated ink absorber 100 lends itself to close and precise dimensional tolerances, yielding increased dimensional qualities in the final absorber product. This increased dimensional accuracy assists in manufacturing the service station 80, because the laminated absorber 100 may be readily assembled into the service station bucket 82 through the use of the mounting projections 122 and slots 98 acting to form a snap fit to secure the absorber in place.

Moreover, the rigidity provided by the support wall tabs 126 engaging with the upper surfaces of slots 98 assists in firmly pushing the core bottom surface 108, which is also the ink exit surface, into contact with the first liner pad 84 inside the spittoon reservoir 83. Positive physical contact between the core bottom surface 108 and the first liner pad 84 assists in facilitating the capillary drawing action to pull the ink spit through core 102 in the direction of arrow 130, and into the liner pad 84. Thus, the laminated ink absorber 100 maintains dimensional stability through the use of the support walls 115, 116, comparable to the porous plastic absorber discussed in the Introduction section above, while providing greater void volume and thus greater waste ink containment than were available with the porous plastic absorber.

Thus, the laminated ink absorber 100 provides the absorption capabilities of the earlier fiber-only absorbers, without suffering from the dimensional variation problems of the earlier fibrous absorbers. Furthermore, the close dimensional control achieved by the fibrous ink absorber 100 allows for closer printhead to absorber spacing, leaving little room between the printhead and absorber for ink aerosol satellites to escape before impacting the spit target 110. In this manner, the laminated absorber 100 assists in reducing troublesome ink aerosol emission, yielding a cleaner printer. Furthermore, the earlier fiber-only ink absorbers were often over compressed, leaving too large of a printhead to absorber spacing, allowing aerosol to escape. Also, the earlier fiber-only ink absorbers often expanded over time, narrowing the printhead to absorber spacing, sometimes having fibers actually impact the printheads 52–56. These earlier spacing problems are alleviated using the laminated ink absorber 100, which is more precisely located with respect to the printheads 72–76, and is easy to assembly because it may be snap fit into place without compressing the core 102.

Furthermore, the non-absorbing nature of the plastic material used to construct walls 115, 116 advantageously isolates ink within the core 102, preventing ink flow in non-desirable directions within the spittoon reservoir 83. Thus, any service station moving components adjacent the outboard wall 115 are isolated from ink contamination as the ink flows through core 102 in the direction of arrow 130. Indeed, use of the laminated absorber 100 simplifies the design of the service station bucket 82, which in earlier designs using a fiber-only absorber required an isolation wall between the absorber and other moving service station components. This isolation wall prevented contamination and fouling of the other servicing components with ink residue from the earlier fiber-only absorbers.

Thus, in a modular, economical to manufacture, and easy to assemble laminated ink absorber system 100, increased ink flow volume is obtained. Furthermore, the system 100 isolates and controls this ink flow through the use of the non-absorbent support walls 115, 116. Besides ink isolation, the walls 115, 116 also serve to provide increased dimensional accuracy and a more uniform printhead to spit target spacing from unit to unit, allowing a closer spacing to trap troublesome inkjet aerosol. The inboard and outboard walls 115, 116 also prevent fibers and contaminates from escaping from the core 102 to interfere with the other service station components.

As a final note, in the illustrated design it is apparent that only a single outboard wall 115 may be used to isolate the ink inside core 102, while still providing adequate support for the absorber system 100, with an adjacent service station inboard wall 138 providing ink isolation along the inboard surface 112 of the core. However, for ease of assembly, forming the absorber 100 as a symmetrical part where either support wail 115 or 116 may serve as the inboard wall aides in preventing costly assembly errors. Similarly, while the illustrated design shows the core 102 as having two large surfaces which are laminated between the inboard and outboard walls 115, 116, it is apparent that in some implementations it may be desirable to have walls 115 and 116 formed in several segments or strips, arranged in a grid or other pattern along the core surface which they support, particularly if ink isolation is not an issue. For instance, since dimensional integrity is required at the spit target surface 110, and along the front and rear surfaces 104, 106 of the core 102, it may be desirable to form walls 115 and 116 as inverted U-shapes. Such U-shaped support walls, or here, more like support arches, may extend partially or totally down along the length of the front and rear surfaces 104, 106, as well as along the entire spit surface 110 where dimensional stability with respect to the printhead to target spacing is desired. Additionally, other implementations may form a laminated structure where the mounting surfaces, such as the front and rear mounting tabs 122 are laminated along with the support walls 115, 116; however, the illustrated design shows the preferred embodiment for the illustrated printer 20.

Thus, it is apparent that a variety of structural equivalents may be used to construct the modular, laminated ink absorber system 100 depending upon the particular implementation employed. These various modifications and equivalents of the concepts covered herein fall within the scope of the claims below.

I claim:

1. A modular ink absorber for absorbing waste ink spit from a printhead in an inkjet printing mechanism having a frame with a mounting member, comprising:

an absorbent core of a first stiffness having a first surface defining a spit target which receives the waste ink, and-a second surface;

a support wall of a second stiffness which is greater than the first stiffness bonded to the second surface of the core; and wherein said support wall has a mating member which is received within the mounting member to secure the ink absorber to the frame.

2. A modular ink absorber according to claim 1:

wherein the core has a third surface opposite the second surface; and further including a second support wall of the second stiffness bonded to the third surface of the core.

3. A modular ink absorber according to claim 1 for a printing mechanism having a frame with a mounting member:

wherein the core has a third surface opposite the second surface;

further including a second support wall of the second stiffness bonded to the third surface to sandwich the core between said support wall and said second support wall; and wherein said support wall and the second support wall each have a mating member which is received within the mounting member to secure the ink absorber to the frame.

4. A modular ink absorber according to claim 3 for a printing mechanism having a frame with a pair of mounting members, wherein said support wall and the second support wall each have a pair of mating members which are each received within an associated one of the pair of mounting members to secure the ink absorber to the frame.

5. A modular ink absorber according to claim 4, wherein said pair of mounting members comprises a pair of slots, and wherein said pair of mating members comprises a pair of tabs.

6. A modular ink absorber according to claim 1 wherein the support wall covers the entire second surface of the core.

7. A modular ink absorber according to claim 3 wherein:

the core is of a fibrous material selected from the group comprising polyester fibers, polypropylene fibers, rayon fibers, polyethylene fibers, nylon fibers, and polyurethane fibers; and the support wall is of polyester, polypropylene, nylon, polyurethane or mylar plastic material.

8. A modular ink absorber for channeling waste ink spit from a printhead in an inkjet printing mechanism having a frame and a mounting member to a permanent storage location, comprising:

an absorbent core having a spit target, which receives the waste ink, an exit surface, and a pair of opposing surfaces;

a pair of support walls of a fluid impervious material each bonded to an associated one of the pair of opposing surfaces of the core;

wherein the exit surface is in fluid communication with the permanent storage location and the support walls channel the ink from the target surface to the permanent storage location; and wherein at least one of said pair of support walls has a mating member which is received within the mounting member to secure the ink absorber to the frame.

9. A modular ink absorber according to claim 8 wherein the pair of support walls each cover the entire pair of opposing surfaces of the core.

10. A method of conducting ink spit from an inkjet printhead to a permanent storage location in an inkjet printhead mechanism having a frame with a mounting member, comprising:

providing an absorber having an absorbent core bonded to a liquid impervious support wall including a mating member which is received within the mounting member to secure the absorber to the frame;

spitting ink onto the absorber;

confining the ink within the core between the support wall and another moisture impervious structure;

channeling the ink from a spit target of the core to an exit surface of the core; and transferring the ink from the core exit surface to the permanent storage location.

11. A method according to claim 10 wherein the confining comprises confining the ink in the core which is sandwiched between a pair of liquid impervious support walls bonded thereto.

12. A method according to claim 11 wherein the channeling comprises channeling the ink between the pair of support walls.

13. A method according to claim 10 further including mounting the absorber to said another moisture impervious structure using said support wall.

14. A method according to claim 10 further including:

the method further includes sandwiching the core between a pair of liquid impervious support walls bonded thereto, each of the pair of liquid impervious support walls including a mating member; and mounting the absorber to the frame by securing the mating members within the mounting member.

15. An inkjet printing mechanism, comprising:

a frame;

an inkjet printhead supported by the frame;

an absorbent core having a spit target, which receives the waste ink, an exit surface, and a pair of opposing surfaces;

a pair of support walls of fluid impervious material each bonded to an associated one of the pair of opposing surfaces of the core; and a permanent storage location in fluid communication with the exit surface;

wherein the frame has a mounting member; and at least one of said pair of support walls has a mating member which is received within the mounting member to secure the core to the frame.

* * * * *